United States Patent [19]

Gronbech

[11] 4,319,474

[45] Mar. 16, 1982

[54] ROLLING METHOD AND APPARATUS

[75] Inventor: Robert W. Gronbech, Sheffield, England

[73] Assignee: Davy-Loewy Limited, Yorkshire, England

[21] Appl. No.: 128,902

[22] Filed: Mar. 10, 1980

[51] Int. Cl.[3] ..... B21B 41/06

[52] U.S. Cl. ..... 72/229; 72/231; 72/234

[58] Field of Search ..... 72/227, 229, 146, 234, 72/226, 231; 242/78, 78.1, 78.6, 78.8

[56] References Cited

U.S. PATENT DOCUMENTS 2,658,741 11/1953 Schmidt et al. ..... 242/78 X
3,803,891 4/1974 Smith ..... 72/231
3,805,570 4/1974 Smith ..... 72/231 X
4,019,359 4/1977 Smith ..... 72/231

*Primary Examiner*—Leon Gilden
*Attorney, Agent, or Firm*—Lee, Smith & Jager

[57] ABSTRACT

Rolling plant for hot rolling metal workpieces comprises a reversing roughing mill, a continuous finishing mill spaced from the roughing mill and an intermediate coiler which can be retracted to an inoperative position clear of the pass-line. In the penultimate forward pass of the roughing mill, the coiler is in its inoperative position and the workpiece is rolled to a length greater than the coiler—roughing mill spacing but less than the finishing mill—roughing mill spacing, the leading end of the workpiece passing under the coiler. In the final forward pass, the coiler is in its operative position on the pass-line and effects coiling of the workpiece. Subsequently, the coil is uncoiled and led out to the finishing mill.

11 Claims, 8 Drawing Figures

ROLLING METHOD AND APPARATUS

Figure 1:
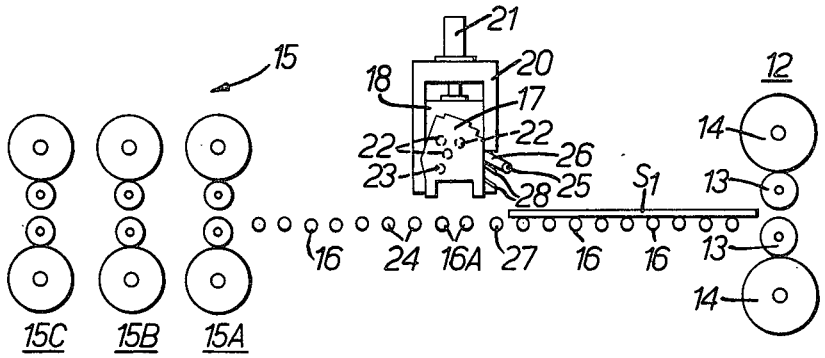

This invention relates to the rolling of hot metal workpieces, e.g. strip or plate, in rolling mill plant comprising a reversing roughing mill and a continuous finishing mill.

U.K. patent specification No. 1373375 describes the rolling of workpieces in such rolling mill plant employing in addition a coiler located between the roughing and finishing mills. According to that specification, on the third last pass of the hot metal workpiece through the roughing mill (the penultimate pass in the forward direction towards the finishing mill), the workpiece is rolled towards the coiler to a length less than the spacing between the roughing mill and the coiler, and, on the last pass, the workpiece is rolled to a length greater than that spacing and is first coiled in the coiler, and then uncoiled and delivered to the finishing mill.

The requirement that, in the penultimate forward pass in the roughing mill, the workpiece must be rolled to a length less than the roughing mill-coiler spacing is a restriction on the plant and on the rolling operation, although with the arrangement illustrated in U.K. patent specification No. 1373375, it is a requirement that cannot easily be avoided. Because of that requirement, either the length of the strip that can be rolled in the rolling mill plant is limited, or the roughing mill-coiler spacing becomes unduly large and the plant is expensive in capital cost.

In the present invention, the restrictions of the abovementioned specification are avoided or mitigated by arranging that the workpiece can pass from the roughing mill towards the finishing mill without being obstructed by the coiler. Then, the workpiece can be rolled in the penultimate forward roughing pass to a length exceeding the roughing mill-coiler spacing, the coiler being at that time inoperative and the leading end of the workpiece extending to the finishing mill side of the coiler location. For the final roughing pass, the coiler is rendered operative and the workpiece coiled in the coiler as it is rolled out by the roughing mill.

Thus, according to the present invention, a method of hot rolling a metal workpiece in a reversing roughing mill followed by a continuous finishing mill with a coiler between those mills comprises the steps of rolling the workpiece in the roughing mill in a series of passes to a gauge for entry to the finishing mill; prior to the penultimate forward pass bringing the coiler into an inoperative condition in which the workpiece can pass the coiler position without obstruction; in the penultimate forward pass rolling the workpiece in the roughing mill to a length exceeding the spacing of the coiler from the roughing mill but less than the spacing of the finishing mill from the roughing mill; after the workpiece has been reversed to clear the coiler position, bringing the coiler into an operative condition for coiling; in the last forward pass coiling the workpiece by the coiler; and then uncoiling the workpiece to the finishing mill. In this specification and claims a "forward pass" means a pass in the direction of the finishing mill.

The invention also provides a rolling mill plant for performing the above method comprising a reversing roughing mill, a continuous finishing mill spaced from the roughing mill, conveying means for conveying workpieces rolled by the roughing mill towards and away from the finishing mill; a coiler located between the roughing mill and the finishing mill for coiling workpieces from the roughing mill and uncoiling the workpieces to the finishing mill, the coiler being movable upwardly and downwardly between an operative position in which a workpiece fed thereto is coiled and an inoperative position in which a workpiece can pass the coiler unobstructed thereby; and means for moving the coiler between the operative and inoperative positions. Alternatively, the plant may comprise a reversing roughing mill, a continuous finishing mill spaced from the roughing mill, conveying means for conveying workpieces rolled by the roughing mill towards and away from the finishing mill, a coiler located between the roughing mill and the finishing mill for coiling workpieces from the roughing mill and uncoiling the workpieces to the finishing mill, the coiler having deflector means movable between a first disposition, in which a workpiece fed from the roughing mill is directed to the coiler, and a second disposition, in which a workpiece fed from the roughing mill passes the coiler without obstruction.

Preferably, the workpiece is rolled in the third last forward pass of the roughing mill to a length which is less than the spacing between the roughing mill and the position of the coiler when in its operative condition.

Figure 3:
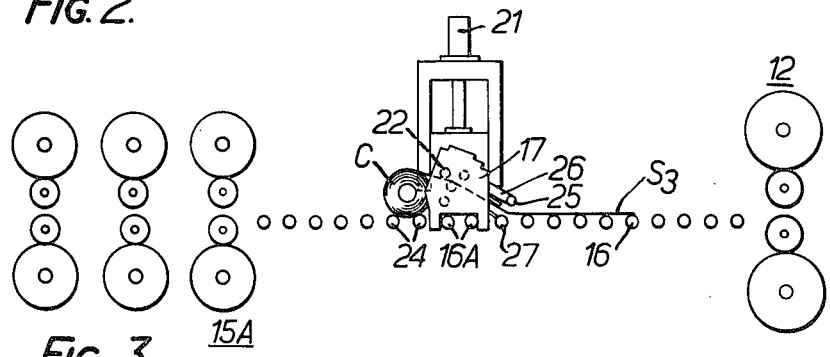
Figure 4:
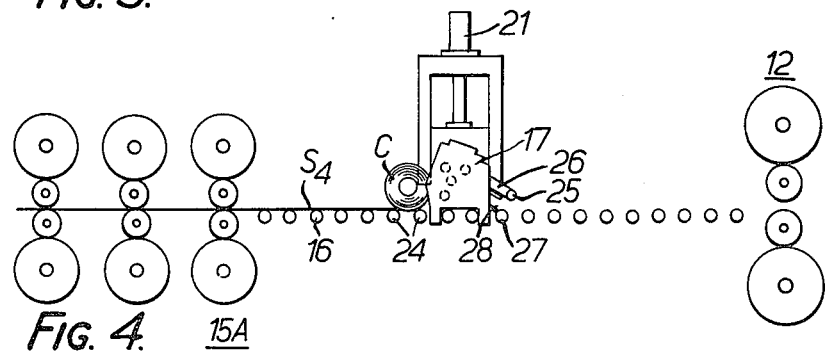
Figure 5:
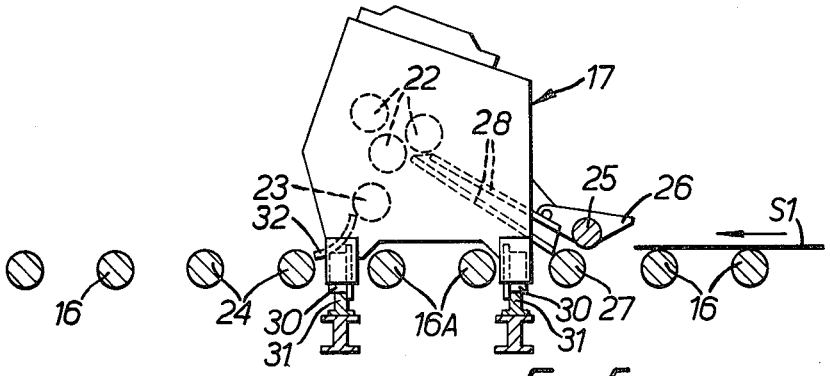
Figure 6:
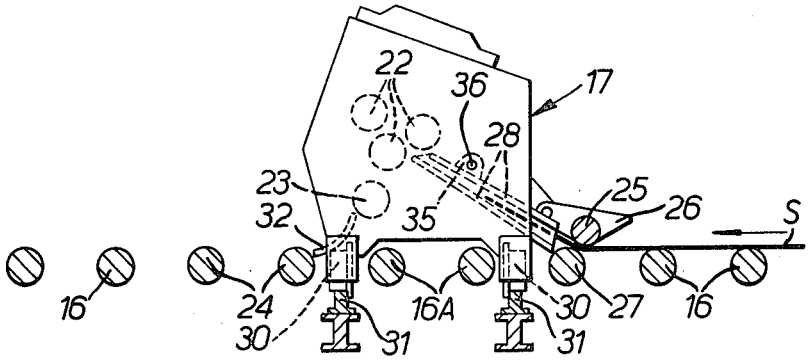
Figure 7:
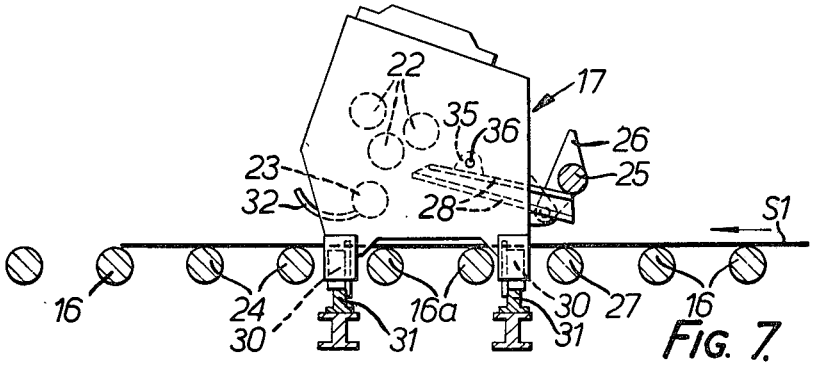
Figure 8:
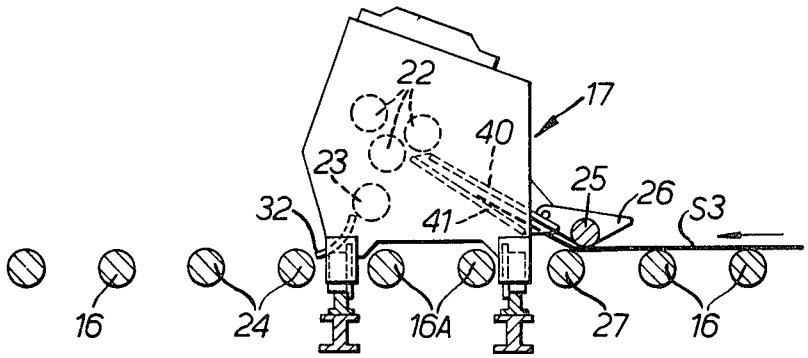

The invention will be more readily understood by way of example from the following description of rolling mill plant and its operation, reference being made to the accompanying drawings, in which FIGS. 1 to 4 show a first form of the plant in successive stages of the operation, FIG. 5 is a side view showing a first modification in which the coiler is movable transversely of the pass-line, FIGS. 6 and 7 are views similar to FIG. 5, but illustrating a second modification in which the coiler guide plates can be displaced, the figures showing the guide plates in operative and inoperative position respectively; and FIG. 8 is a similar view illustrating yet another modification.

The rolling mill plant comprises basically a reversing roughing mill 12 illustrated by work rolls 13 and backup rolls 14 and a continuous finishing mill 15 represented by the rolls of the first three stands 15A, 15B and 15C. The roughing mill 12 and the finishing mill 15 are spaced apart in the direction of the common pass-line, and between them is a sequence of driven table rollers 16 forming conveying means by which a workpiece rolled out by the roughing mill 12 towards the finishing mill 15 can be traversed in either direction. Between the roughing mill and the finishing mill is a mandrel-less coiler 17 which is generally as described and illustrated in U.K. patent specification No. 1373375 except as hereinafter described. The arrangement of roughing mill, coiler and finishing mill is thus as shown in FIG. 4 of that specification.

The coiler 17 shown in FIGS. 1 to 4 differs from that of the above mentioned specification by being carried by a frame 18 which is mounted in slideways 20 at each side. Piston and cylinder assemblies, one of which is illustrated at 21, are effective to move the coiler 17 between an inoperative position shown in FIGS. 1 and 2, in which the coiler is raised above the pass-line of the table rollers 16, and an operative position shown in FIGS. 3 and 4, in which the coiler is on that pass-line and can coil hot rolled slab conveyed on the rollers 16. As will be observed there are two table rollers 16A aligned with the other rollers 16 and located beneath the coiler 17.

The coiler 17 is as shown in FIG. 6 of U.K. patent specification No. 1373375 to which reference should be made for a detailed explanation of its construction and operation. The coiler has a set of bending rolls 22, a driven cradle roll 23 which cooperates with two further driven cradle rolls 24 on the pass-line, a pinch-roll 25 which is carried on a pivotable lever 26 and which cooperates with a second pinch roll 27 on the pass-line, and deflection or guide plates 28.

Each new slab is hot rolled in roughing mill 12 in a series of reversing passes, such that after the fifth last pass (the third last pass in the forward direction towards the coiler), the resulting rolled workpiece occupies most of the roller table between the mill 12 and the coiler 17, but has a length less than the separation of the coiler from the mill 12; the workpiece $S_1$ after that pass is shown in FIG. 1. At that stage, or before, the coiler is raised to its inoperative position as shown.

Figure 2:
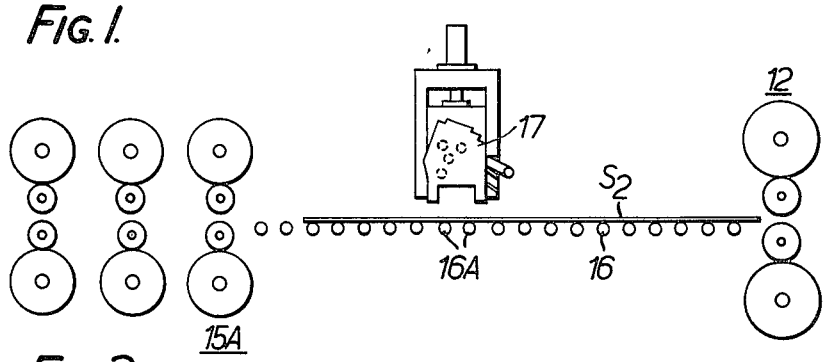

In the penultimate forward pass of the workpiece, the coiler 17 is still in its inoperative position and the rolled workpiece $S_2$ has been rolled down to a length which exceeds the separation of the coiler 17 from the roughing mill 12, but is less than the separation of the first stand 15A of the finishing mill from the roughing mill. As the workpiece is run out from the roughing mill its leading end passes unobstructed under the coiler, being supported beneath the coiler by the rollers 16A (FIG. 2).

The workpiece $S_2$ is next reversed for the final rearward pass. As soon as the workpiece clears the coiler position, the piston and cylinder assemblies 21 are operated to bring the coiler into its operative position, and at the same time the lever 26 is operated to bring the upper pinch roll 25 into its working position adjacent the lower pinch roll 27, but slightly displaced from it in the direction of the roughing mill (FIG. 3).

In the final forward pass, the workpiece is rolled out at length exceeding the finishing mill-roughing mill spacing. As the leading end in that pass approaches the coiler, it is gripped between, and deflected upwards by, the pinch rolls 25, 27 and is directed between guide plates 28 and to the bending rolls which form the rolled workpiece $S_3$ into a coil C on the driven cradle rolls 24 as described in the said patent specification. As soon as the leading end reaches the bending rolls, pinch roll 25 can be raised away from pinch roll 27 a small extent and then acts to guide the rolled workpiece. When the tail of the workpiece is detected, the cradle rolls are decelerated and come to rest with the tail end above the cradle rolls. The cradle rolls are subsequently driven in the opposite direction to pay out the rolled workpiece, as indicated at $S_4$ in FIG. 4, towards the finishing stand 15 which rolls the workpiece down to strip. After the coil C has been formed on the cradle rolls 24, the coiler 17 can be retracted into its inoperative position to allow the next workpiece to pass under it when the coil C has been exhausted.

Because in the penultimate forward pass the coiler in its inoperative position does not impede the movement of the workpiece past the coiler position, the length of the workpiece rolled out in that pass is limited only by the separation between the roughing mill and the first stand of the finishing mill. Compared with the rolling operation of British patent specification No. 1373375, the length of workpiece rolled out in the final pass, and hence the slab weight, can be increased with the same spacing of roughing mill and finishing mill; or, with the same slab weight, the roughing mill-finishing mill spacing can be decreased. By using a retractable coiler it is thus possible to achieve better operating efficiency, or a capital cost saving, or both.

The operational improvement outlined in the last paragraph is achieved by having a coiler which can at will be rendered operative to coil workpiece S, or non-operative when the workpiece is allowed to pass the coiler location without being subject to coiling. In FIGS. 1 to 4, the coiler 17 is rendered non-operative by being upwardly retractable from the pass-line; however other arrangements are possible in order to achieve the same end, as illustrated for example in FIGS. 5 to 8.

In FIG. 5, the coiler 17 instead of being mounted for movement in the slideways 20 is supported on wheels 30 which run on a pair of rails 31 extending at right angles to the pass-line but below its level, i.e. as illustrated in FIG. 6 of the above-mentioned British patent specification. The coiler is shown in its operative position in which the workpiece $S_1$ is led to, and formed into a coil by, the bending rolls 22; to bring it into its inoperative position, the coiler 17 with roller 25, the guide plates 28 and a guide 32 which assists in the formation of the coil is moved on the rails 31 to one side of the pass-line, so that the workpiece can pass the coiler location on the rollers 16A.

The operation is as described in relation to FIGS. 1 to 4: the coiler 17 is in inoperative position to one side of the pass-line up to and including the penultimate forward pass. As soon as the workpiece clears the coiler position in its final rearward pass, the coiler 17 is moved into its operative position on the pass-line and is effective to form the workpiece into a coil in the final forward pass. Then, as before, the coil is paid out to the finishing stand.

In the further modification of FIGS. 6 and 7, the coiler 17 although again shown as mounted on the wheels 30 and rails 31 is intended to remain in position over the pass-line throughout the entire rolling operation, the rail mounting being used only to enable the coiler to be brought out of line for servicing. In FIGS. 6 and 7, the coiler is rendered inoperative by moving the guide plates 28 and the upper roller 25 of the pinch rolls out of potential engagement with the workpiece S. For that purpose the guide plates 28 are supported on lugs 35 mounted on a transverse shaft 36.

FIG. 6 shows the coiler in operative disposition; to render it inoperative, the roller 25 is raised away from roller 27, the guide plates 28 are pivoted about shaft 36, and the coiling guide 32 is similarly pivoted out of the pass-line below the coiler. In the inoperative disposition, shown in FIG. 7, there is nothing to obstruct the passage of the workpiece along the path defined by the rollers 16, 27, 16A and 24, since the coiler is supported on its wheels 30 at each side of the pass-line.

As illustrated by FIG. 8, it is not always necessary that the guide plates should be pivotably mounted as in FIGS. 6 and 7. Instead, the guide plates may be fixed in relation to the coiler 17. The upper guide plates, indicated in FIG. 8 at 40 is similar to the corresponding plate of FIG. 5, but the lower guide plate 41 is shorter and terminates at its lower end well above the workpiece pass-line. Transfer from operative to inoperative position and vice versa is then effected solely by pivoting of the lever 26 carrying the upper roller 25 of the pinch rolls 25, 27. FIG. 8 shows the operative disposition with the rollers 25, 27 closely adjacent; because, in that position, the roller 25 is offset from the roller 27 towards the roughing mill, the workpiece as it enters the pinch works is bent upwards so that its leading end enters the throat between the guide plates 40, 41 and the workpiece is guided to the bending rolls 22.

To bring the coiler into its inoperative disposition, the lever 26 is lifted to bring the roller 25 well above the workpiece pass-line and similarly the guide 32 is raised to the position shown in FIG. 7. In the penultimate forward pass of the workpiece away from the reversing mill, the workpiece is then able to pass the coiler location without obstruction moving over the roller 27, under the guide plate 41, and over the rollers 16A to the finishing mill side of the coiler.

I claim:

1. In a method of hot rolling a metal workpiece in a reversing roughing mill followed by a continuous finishing mill with a coiler between those mills, the steps of (a) rolling said workpiece in said roughing mill in a series of passes to a gauge for entry to said finishing mill;

(b) prior to the penultimate forward pass, bringing said coiler into an inoperative condition in which said workpiece can pass the coiler location without obstruction;

(c) in the penultimate forward pass rolling said workpiece in said roughing mill to a length exceeding the spacing of said coiler from said roughing mill but less than the spacing of said finishing mill from said roughing mill;

(d) after said workpiece has been reversed towards said roughing mill to clear said coiler position, bringing said coiler into an operative condition for coiling;

(e) in the last forward pass coiling said workpiece by said coiler; and (f) then uncoiling said workpiece to said finishing mill.

2. A method of hot rolling a metal workpiece according to claim 1, in which said coiler is moved upwardly between said operative and inoperative conditions.

3. A method of hot rolling a metal workpiece according to claim 2, in which said coiler is moved horizontally between said operative and inoperative conditions.

4. A method of hot rolling a metal workpiece according to claim 1, in which said coiler remains in the same position in said operative and inoperative conditions and deflector means are moved to a first position to direct said workpiece to said coiler in order to bring said coiler into said operative condition, and are moved to a second position, in which said workpiece can pass the coiler unobstructed and without being coiled, in order to bring said coiler into said inoperative condition.

5. Rolling mill plant for hot rolling metal workpieces comprising (a) a reversing roughing mill, (b) a continuous finishing mill spaced from said roughing mill, (c) conveying means for conveying workpieces rolled by said roughing mill towards and away from said finishing mill;

(d) a coiler located between said roughing mill and said finishing mill for coiling workpieces from said roughing mill and uncoiling the workpieces to said finishing mill, (e) said coiler being movable between an operative position in which a workpiece fed thereto is coiled and an inoperative position in which a workpiece can pass the coiler unobstructed thereby; and (f) means for moving said coiler between said operative and inoperative positions.

6. Rolling mill plant according to claim 5, in which said coiler is movable upwardly between said operative position and said inoperative position.

7. Rolling mill plant according to claim 5, in which said coiler is movable horizontally between said operative position and said inoperative position.

8. Rolling mill plant for hot rolling metal workpieces comprising (a) a reversing roughing mill, (b) a continuous finishing mill spaced from said roughing mill, (c) conveying means for conveying workpieces rolled by said roughing mill towards and away from said finishing mill; and (d) a coiler located between said roughing mill and said finishing mill for coiling workpieces from said roughing mill and uncoiling the workpieces to said finishing mill, (e) said coiler having deflector means movable between a first disposition, in which a workpiece fed from said roughing mill is directed to said coiler, and a second disposition, in which a workpiece fed from said roughing mill passes said coiler without obstruction or coiling.

9. Rolling mill plant according to claim 8, in which said coiler includes coil forming means and said deflector means include a guide plate which leads to said coil forming means and which in the operative disposition lies in the workpiece path on said conveyor means and which in the inoperative disposition is displaced from said path.

10. Rolling mill plant according to claim 8, in which said deflector means include a pair of pinch rolls in the workpiece path of said conveyor means, and a guide passage leading from said pinch rolls to said coiler but located above said path, the upper of said pinch rolls being movable relative to the lower of said pinch rolls between a first position, in which said pinch rolls deflect said workpiece upwardly away from said path and into said passage, and a second position, in which said upper of said pinch rolls is above said path and said workpiece avoids said passage and passes beneath said coiler.

11. In a method of hot rolling a metal workpiece in a reversing roughing mill followed by a continuous finishing mill with a coiler between those mills, the steps of (a) rolling said workpiece in said roughing mill in a series of passes to a gauge for entry to said finishing mill;

(b) prior to the penultimate forward pass, retracting said coiler out of the pass-line of said mills, and thereby bringing said coiler into an inoperative condition in which said workpiece can pass the coiler location without obstruction;

(c) in the penultimate forward pass rolling said workpiece in said roughing mill to a length exceeding the spacing of said coiler from said roughing mill but less than the spacing of said finishing mill from said roughing mill;

(d) after said workpiece has been reversed towards said roughing mill to clear said coiler position, bringing said coiler into an operative condition for coiling by moving said coiler into said pass-line;

(e) in the last forward pass coiling said workpiece by said coiler; and (f) then uncoiling said workpiece to said finishing mill.

* * * * *